US010221640B2

(12) United States Patent
Nordenstam et al.

(10) Patent No.: US 10,221,640 B2
(45) Date of Patent: Mar. 5, 2019

(54) METHOD AND SYSTEM FOR ABANDONING A CASED BOREHOLE

(71) Applicants: Erik Vilhelm Nordenstam, The Woodlands, TX (US); Lei Fang, Katy, TX (US)

(72) Inventors: Erik Vilhelm Nordenstam, The Woodlands, TX (US); Lei Fang, Katy, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 133 days.

(21) Appl. No.: 15/337,941

(22) Filed: Oct. 28, 2016

(65) Prior Publication Data

US 2018/0119507 A1 May 3, 2018

(51) Int. Cl.

| | |
|---|---|
| ***E21B 29/00*** | (2006.01) |
| ***E21B 37/04*** | (2006.01) |
| ***E21B 47/12*** | (2012.01) |

(52) U.S. Cl.

CPC ..... *E21B 29/005* (2013.01); *E21B 37/04* (2013.01); *E21B 47/12* (2013.01)

(58) Field of Classification Search

CPC .... E21B 29/002; E21B 29/005; E21B 29/007; E21B 37/02; E21B 37/04; E21B 47/09; E21B 47/12; E21B 33/138

See application file for complete search history.

(56) References Cited

U.S. PATENT DOCUMENTS

| | | | |
|---|---|---|---|
| 2,690,897 | A | 10/1954 | Clark, Jr. |
| 2,976,927 | A | 3/1961 | Kammerer |
| 3,289,760 | A | 12/1966 | Kammerer |
| 5,255,741 | A | 10/1993 | Alexander |
| 6,478,088 | B1 | 11/2002 | Hansen et al. |
| 6,920,923 | B1 | 7/2005 | Pietrobelli et al. |
| 7,380,603 | B2 | 6/2008 | Jeffrey et al. |
| 8,528,630 | B2 | 9/2013 | Tunget |
| 8,955,597 | B2 | 2/2015 | Connell et al. |
| 2010/0032170 | A1 | 2/2010 | Howett et al. |
| 2011/0017450 | A1 | 1/2011 | Pietrobelli et al. |
| 2011/0127035 | A1 | 6/2011 | Hansen et al. |
| 2011/0220357 | A1 | 9/2011 | Segura et al. |
| 2013/0105158 | A1 | 5/2013 | Saltel |

(Continued)

OTHER PUBLICATIONS

Charles H. Dewey et al., "Drilling and underreaming Simultaneously: A Cost-Effective Option"; Society of Petroleum Engineers; SPE Paper No. 36462; Oct. 6, 1996 (4 pp.).

(Continued)

*Primary Examiner* — Michael R Wills, III
(74) *Attorney, Agent, or Firm* — Cantor Colburn LLP

(57) ABSTRACT

A milling and scraping tool for preparing a borehole to be plugged includes a tool body including a first end, a second end, and an intermediate portion extending therebetween and a milling system arranged between the first end and the second end. The milling system includes one or more selectively deployable milling blades. The one or more selectively deployable milling blades is shiftable between a retracted position and a deployed position. A scraping system is arranged on the tool body. The scraping system includes a plurality of selectively deployable scraping blades selectively deployable from a retracted position to a deployed position.

20 Claims, 4 Drawing Sheets

(56) References Cited

U.S. PATENT DOCUMENTS

| | | | | |
|---|---|---|---|---|
| 2013/0199785 | A1 | 8/2013 | Hekelaar et al. | |
| 2015/0354306 | A1* | 12/2015 | Fuller | E21B 29/005 166/285 |
| 2017/0009546 | A1* | 1/2017 | Krieg | E21B 23/04 |
| 2017/0044834 | A1* | 2/2017 | Peters | E21B 10/322 |

OTHER PUBLICATIONS

J.M. Greener et al., "Underreamer Improvements for Drilling Moving Salt Formations"; Society of Petroleum Engineers; SPE/IADC Paper No. 18700; Feb. 28, 1989 (10 pp.).

Notification of Transmittal of the International Search Report and the Written Opinion of the International Searching Authority; PCT/US2012/040486; dated Dec. 21, 2012 (7 pp.).

Schlumberger; "ProMILL Trip Saving Milling and Underreaming System;" 2 Pages; slb.com/ProMill.

* cited by examiner

METHOD AND SYSTEM FOR ABANDONING A CASED BOREHOLE

BACKGROUND

Often times it becomes desirable to abandon a borehole created in connection with resource exploration and/or extraction operations. There exists a wide array of reasons for closing and abandoning, either temporarily or permanently a borehole. A borehole may not have developed sufficient resources to justify further operations, resources may have, overtime, become depleted, or a myriad of other reasons may exist to justify abandoning a borehole.

When abandoning a borehole, a plug is installed to prevent any leakage. Typically the plug includes a cement column having a desired height ranging from several tens of feet to hundreds of feet. In order to reduce any potential leakage, a portion of an inner casing may be removed. Following removal of the inner casing, cement and other debris is removed up to an outer casing. Removing the inner casing requires running in a milling tool, milling a portion of the inner casing at a particular location, and then withdrawing the milling tool.

With the portion of the inner casing removed, a scraper may be run downhole to clean up any residual cement and other debris out to the outer casing. Once the debris is removed, the scraper is removed and yet another tool is run downhole to perform a cementing operation. Each tool run takes time and resources that add to an overall cost of plugging and abandoning a borehole. Systems that would reduce the number of operations required to plug a borehole would be well received in the industry.

SUMMARY

A milling and scraping tool for preparing a borehole to be plugged includes a tool body including a first end, a second end, and an intermediate portion extending therebetween and a milling system arranged between the first end and the second end. The milling system includes one or more selectively deployable milling blades. The one or more selectively deployable milling blades is shiftable between a retracted position and a deployed position. A scraping system is arranged on the tool body. The scraping system includes a plurality of selectively deployable scraping blades selectively deployable from a retracted position to a deployed position.

A method of preparing a borehole for abandonment includes running a milling and scraping tool into a borehole having an inner casing and an outer casing separated by cement, cutting the inner casing with a plurality of selectively deployable milling blades of a milling system portion of the milling and scraping tool, and scraping away the cement up to the outer casing with a plurality of selectively deployable scraping blades of a scraping system portion of the milling and scraping tool.

BRIEF DESCRIPTION OF THE DRAWINGS

Referring now to the drawings wherein like elements are numbered alike in the several Figures.

DETAILED DESCRIPTION

Figure 1:
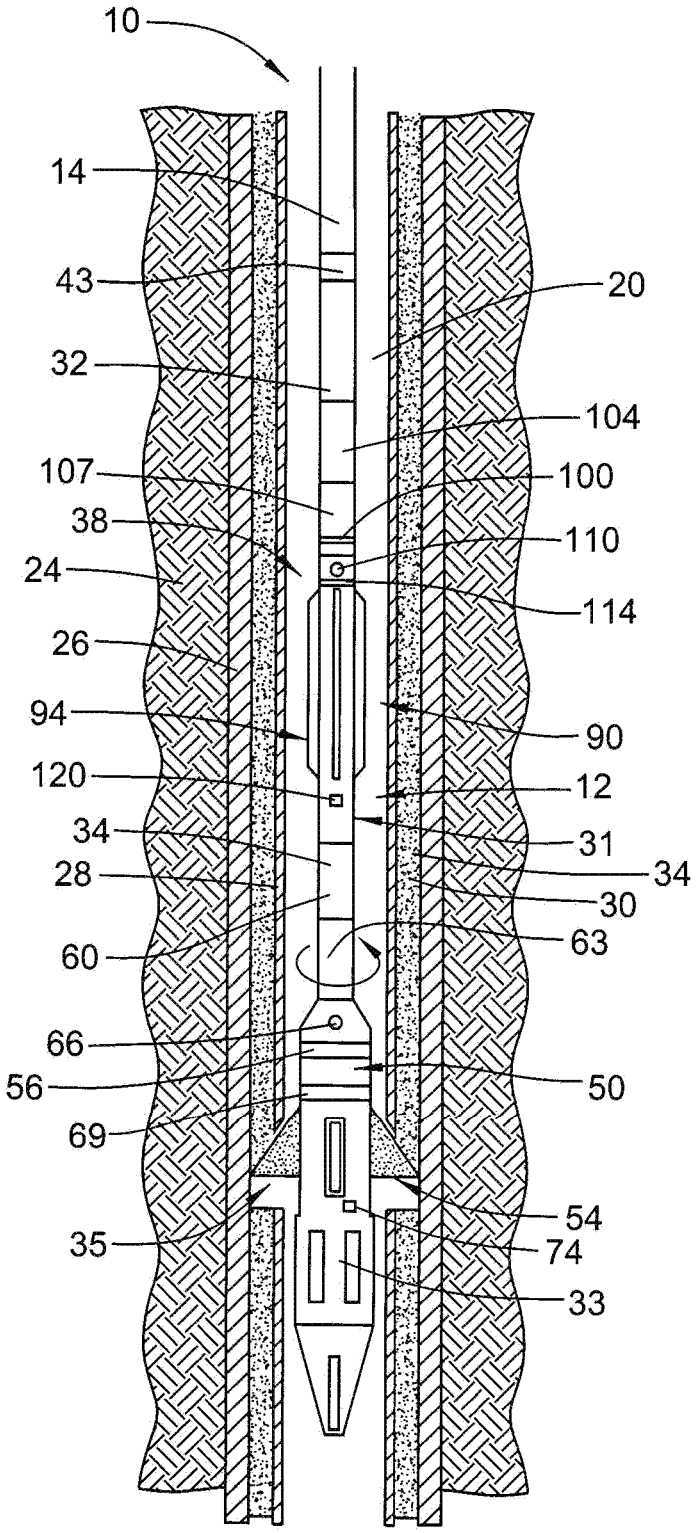
FIG. 1 depicts a milling and scraping tool during a milling operation in a borehole, in accordance with an exemplary embodiment.

A system for preparing a borehole for abandonment is illustrated generally at 10 in FIG. 1. System 10 includes a milling and scraping tool 12 detachably connected to a tubular 14. Milling and scraping tool 12 is shown positioned in a borehole 20 formed in a formation 24. Borehole 20 includes a liner or outer casing 26 and an inner casing 28 separated by an amount of cement 30. Prior to abandonment, a portion of inner casing 28 is removed. Outer casing 26 is scraped or cleaned to remove residual cement 30 as will be detailed below.

Milling and scraping tool 12 includes a tool body 31 including a first end 32, a second end 33 and an intermediate portion 34. Milling and scraping tool 12 further includes a milling system portion 35 arranged toward second end 33 and a scraping system portion 38 arranged along intermediate portion 34. A valve 43 may be arranged uphole of milling system portion 35 and scraping system portion 38. Valve 43 may be selectively controlled to deliver a flow of fluid to one or more of milling system portion 35 and scraping system portion 38 to prepare borehole 20 for abandonment.

Milling system portion 35 includes a milling system 50 that is selectively operated to facilitate removal of a portion of inner casing 28. Milling system 50 includes a plurality of selectively deployable milling blades 54 that may be extended, radially outwardly, in contact with an inner surface (not separately labeled) of inner casing 28. An activation mechanism 56 may be controlled to selectively shift plurality of milling blades 54 from a retracted position (FIG. 2) to a deployed position (FIG. 1). Once deployed, milling and scraping tool 12 is rotated about a longitudinal axis to promote cutting of inner casing 28 be selectively deployable milling blades 54.

In accordance with an aspect of an exemplary embodiment, milling system 50 may include a telemetry module 60 that promotes two-way communication with a surface system (not shown) and a hydraulic pump module 63 that may be selectively activated to deploy and/or retract selectively deployable milling blades 54 as well as circulate a fluid through a port 66 during a cutting operation. Milling system 50 may also include a locking mechanism 69 that maintains the plurality of milling blades 54 in each of the deployed position and the retracted position in order to reduce reliance on hydraulic pump module 63 and a constant fluid supply. Milling system 50 may also include a sensor 74 that provides feedback to the surface system via telemetry module 60 regarding milling blade position as well as other downhole parameters.

Figure 2:
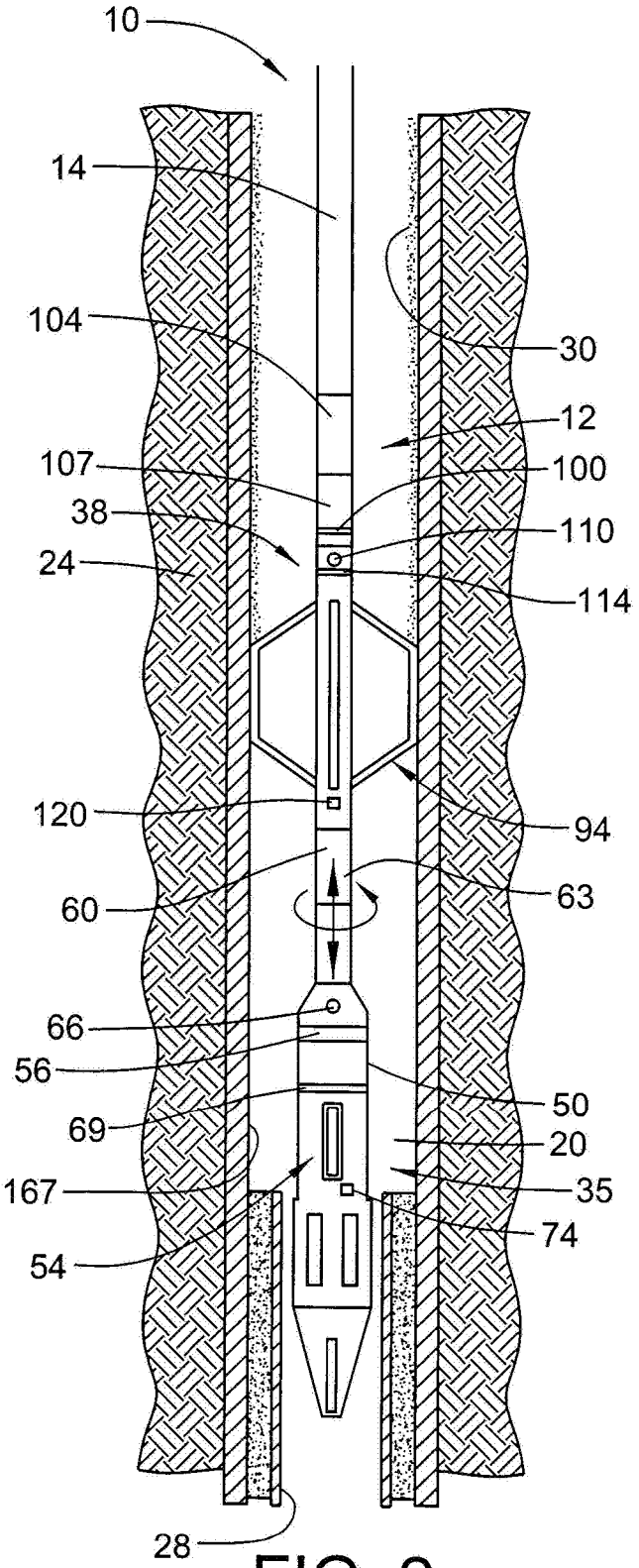
FIG. 2 depicts the milling and scraping tool of FIG. 1 during a scraping operation, in accordance with an exemplary embodiment.

In further accordance with an exemplary aspect, scraping system portion 38 includes a scraping system 90 having a plurality of selectively deployable scraping blades 94. Scraping system 90 includes an activation mechanism 100 that selectively shifts the plurality of scraping blades 94 between a retracted position (FIG. 1) and a deployed position (FIG. 2). The plurality of scraping blades 94 may include one or more linkages or hinges (not separately labeled) that facilitate a transition between the retracted and deployed positions.

In still further accordance with an exemplary aspect, scraping system portion 38 includes a telemetry and power module 104 that promotes two-way communication with the surface system and may provide power to operate scraping system 90 and milling system 50. Telemetry and power module 104 may communicate with surface system 4 through a wired connection or, alternatively, through a wireless communication protocol. Scraping system portion 38 also includes a hydraulic pump and piston module 107 that may be selectively operated to provide recirculating fluid through a port 110 as well as to provide a motive force for shifting the plurality of scraping blades 94 between the retracted and the deployed positions.

In yet still further accordance with an exemplary aspect, scraping system portion 38 includes a locking mechanism 114 that may selectively maintain the plurality of scraping blades 94 in either the retracted position or the deployed position. In this manner, scraping system 90 does not need to rely on a constant flow of fluid from hydraulic pump and piston module 107. Scraping system portion 38 also includes a sensor 120 that may provide feedback to the surface system through telemetry and power module 104 regarding a position of the plurality of scraping blades 94 as well as other downhole parameters.

Figure 3:
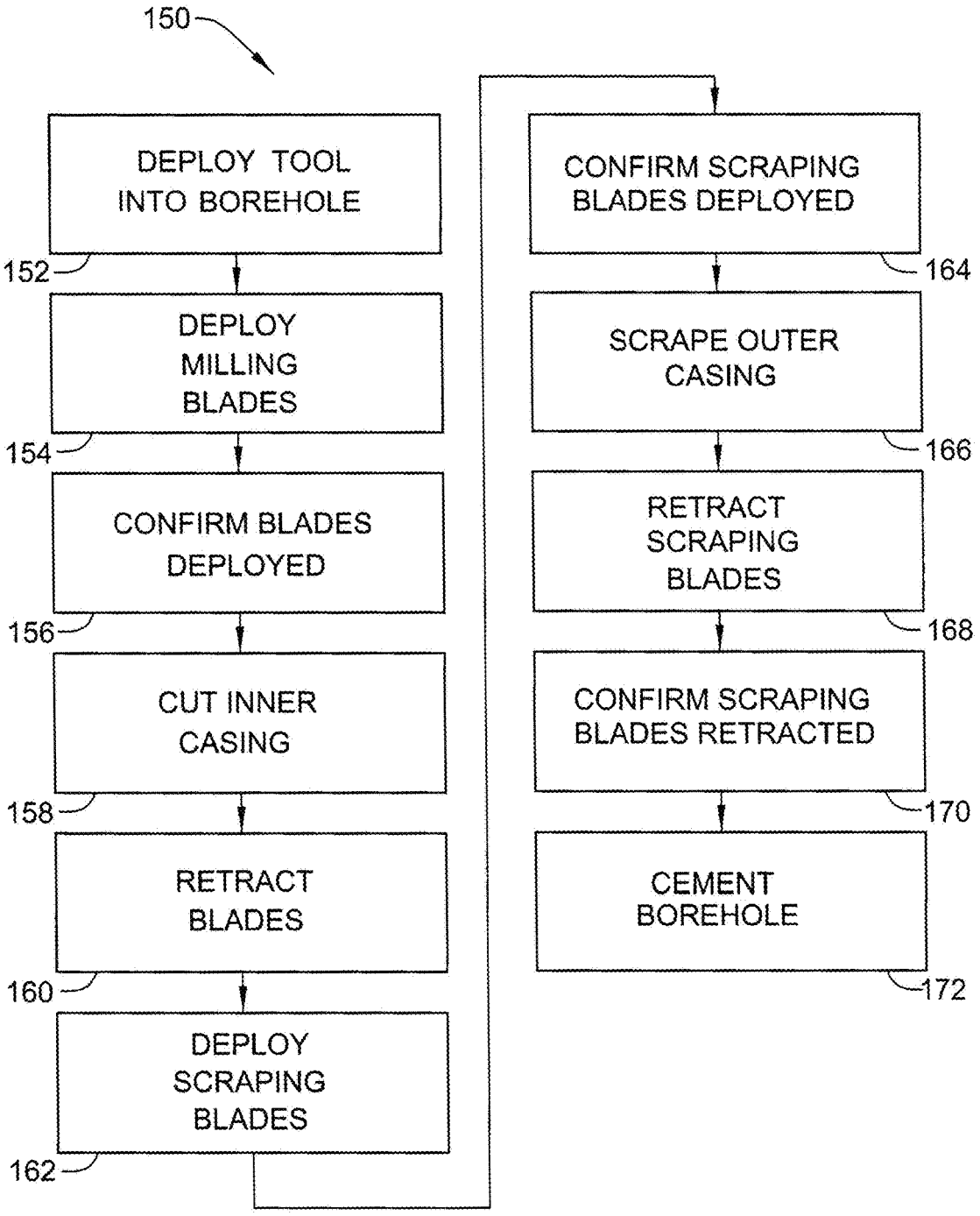
FIG. 3 is a flow chart depicting a method of preparing a borehole for abandonment, in accordance with an aspect of an exemplary embodiment.

Reference will now follow to FIG. 3 in describing a method 150 of preparing a borehole for abandonment. In block 152, milling and scraping tool 12 is deployed downhole to a desired depth. The plurality of selectively deployable milling blades 54 are deployed as indicated in block 154. Sensor 74 provides a signal to the surface system indicating that the plurality of selectively deployable milling blades 54 is deployed and in position in block 156. Milling and scraping tool 12 is then rotated, as indicted in block 158 to mill inner casing 28. At this point, a portion of inner casing 28 may be withdrawn uphole. The plurality of selectively deployable milling blades 54 may then be retracted as indicated in block 160 and the plurality of selectively deployable scraping blades 94 extended outwardly as indicated in block 162.

Figure 4:
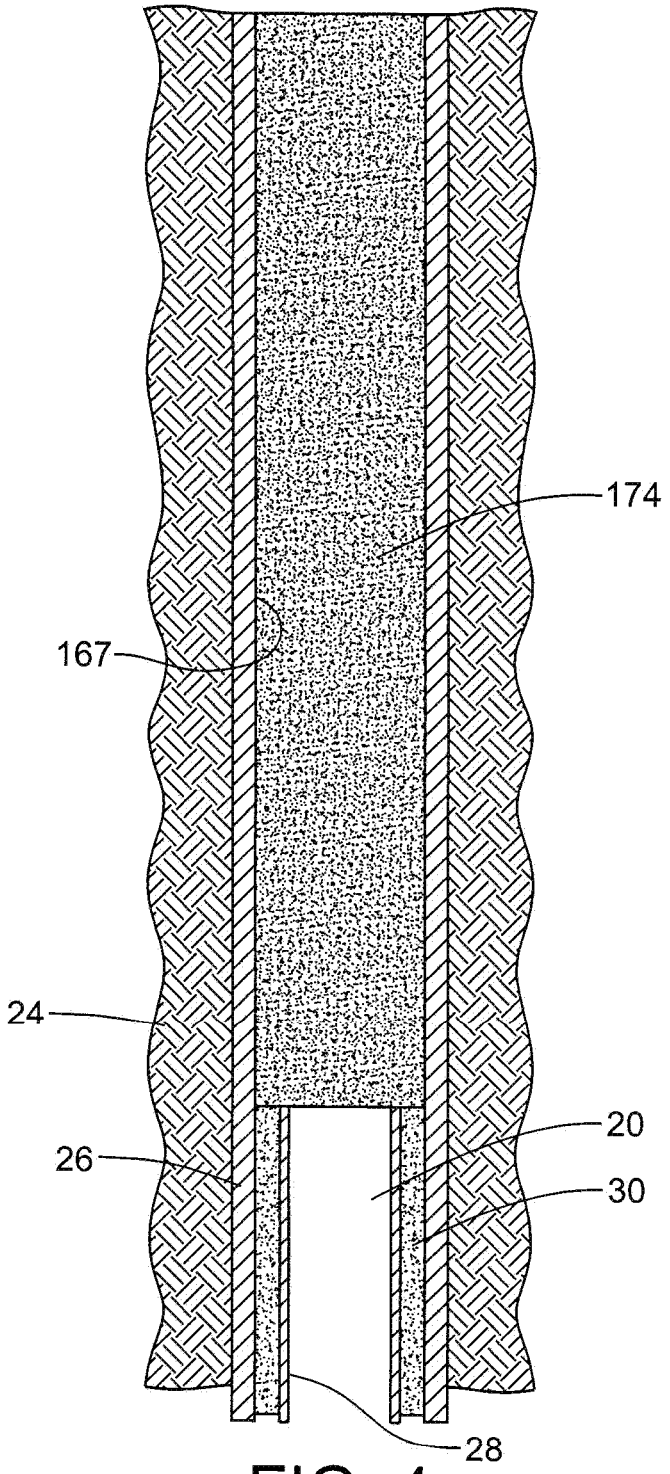
FIG. 4 depicts the borehole of FIG. 1 following a plugging operation.

In block 164 sensor 120 provides confirmation that the plurality of selectively deployable scraping blades 94 have deployed outwardly to a surface 167 (FIG. 2) of outer casing 26. Milling and scraping tool 12 may then be rotated and slowly drawn uphole to remove any residual cement and/or debris from surface 167 as indicated in block 166. After scraping, the plurality of selectively deployable scraping blades 94 may then be retracted as indicated in block 168. Sensor 120 may send a signal confirming that the plurality of selectively deployable scraping blades 94 have retracted in block 170. At this point, in block 172, cement may be introduced into borehole 20 to form a plug 174 as shown in FIG. 4. The cement may pass through milling and scraping tool 12 or may be introduced through a separate tubular.

Further included in this disclosure are the following specific embodiments, which do not necessarily limit the claims.

Embodiment 1

A milling and scraping tool for preparing a borehole to be plugged, the milling and scraping tool comprising: a tool body including a first end, a second end, and an intermediate portion extending therebetween; a milling system arranged between the first end and the second end, the milling system including one or more selectively deployable milling blades, the one or more selectively deployable milling blades being shiftable between a retracted position and a deployed position; and a scraping system arranged on the tool body, the scraping system including a plurality of selectively deployable scraping blades selectively deployable from a retracted position to a deployed position.

Embodiment 2

The milling and scraping tool according to embodiment 1, further comprising: a locking mechanism operatively connected to the plurality of selectively deployable scraping blades, the locking mechanism selectively locking the plurality of selectively deployable scraping blades in each of the retracted position and the deployed position.

Embodiment 3

The milling and scraping tool according to embodiment 2, further comprising: another locking mechanism operatively associated with the one or more selectively deployable milling blades.

Embodiment 4

The milling and scraping tool according to embodiment 1, further comprising: at least one telemetry and power module operable to communicate with a surface system.

Embodiment 5

The milling and scraping tool according to embodiment 4, wherein the at least one telemetry and power module is operable to communicate with the surface system through one of a wired connection and a wireless connection.

Embodiment 6

The milling and scraping tool according to embodiment 4, wherein the at least one telemetry and power module includes a first telemetry and power module operatively associated with the milling system and a second telemetry and power module operatively associated with the scraping system.

Embodiment 7

The milling and scraping tool according to embodiment 1, further comprising: an activation mechanism operatively associated with at least one of the milling system and the scraping system, the activation mechanism being operable to selectively shift at least one of the one or more selectively deployable milling blades and the plurality of selectively deployable scraping blades between the retracted position and the deployed position.

Embodiment 8

The milling and scraping tool according to embodiment 7, further comprising a sensor operatively associated with at least one of the activation mechanism and at least one of the plurality of selectively deployable scraping blades, the sensor being operable to determine a position of the selectively deployable plurality of scraping blades.

Embodiment 9

The milling and scraping tool according to embodiment 1, further comprising: a hydraulic pump and piston module operatively associated with the scraping system, the hydraulic pump and piston module being operable to deliver a stream of fluid from the milling and scraping tool during a scraping operation.

Embodiment 10

The milling and scraping tool according to embodiment 9, wherein the hydraulic pump and piston module is operable to selectively shift the plurality of selectively deployable scraping blades between the deployed position and retracted position.

Embodiment 11

The milling and scraping tool according to embodiment 9, further comprising: a hydraulic pump module operatively associated with the milling system, the hydraulic pump module being operable to deliver a stream of fluid from the milling and scraping tool during a milling operation.

Embodiment 12

A method of preparing a borehole for abandonment comprising: running a milling and scraping tool into a borehole having an inner casing and an outer casing separated by cement; cutting the inner casing with a plurality of selectively deployable milling blades of a milling system portion of the milling and scraping tool; and scraping away the cement up to the outer casing with a plurality of selectively deployable scraping blades of a scraping system portion of the milling and scraping tool.

Embodiment 13

The method of embodiment 12, further comprising: circulating fluid over the plurality of selectively deployable milling blades while cutting the inner casing.

Embodiment 14

The method of embodiment 12, further comprising: circulating fluid over the plurality of selectively deployable scraping blades while scraping away the cement.

Embodiment 15

The method of embodiment 12, further comprising: signaling to the scraping system portion to shift the plurality of selectively deployable scraping blades to a deployed position.

Embodiment 16

The method of embodiment 15, further comprising: signaling to a surface system that the plurality of selectively deployable scraping blades has deployed.

Embodiment 17

The method of embodiment 15, further comprising: locking the plurality of selectively deployable scraping blades in the deployed position.

Embodiment 18

The method of embodiment 12, further comprising: signaling to the scraping system portion to shift the plurality of selectively deployable scraping blades to a retracted position.

Embodiment 19

The method of embodiment 18, further comprising: signaling to a surface system that the plurality of selectively deployable scraping blades has retracted.

Embodiment 20

The method of embodiment 18, further comprising: locking the plurality of selectively deployable scraping blades in the retracted position.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc.

It is to be understood that the exemplary embodiments provide a system that prepares a borehole for abandonment with minimal tool deployments and withdrawals. In this manner, the exemplary embodiments reduce time, labor and other costs associated with permanently or semi-permanently closing a borehole.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A milling and scraping tool for preparing a borehole to be plugged, the milling and scraping tool comprising:

a tool body including a first end, a second end, and an intermediate portion extending therebetween;

a milling system arranged between the first end and the second end, the milling system including one or more selectively deployable milling blades, the one or more selectively deployable milling blades being shiftable between a retracted position and a deployed position; and a scraping system arranged on the tool body, the scraping system including a plurality of selectively deployable scraping blades selectively deployable from a retracted position to a deployed position to clean an inner surface of a tubular.

2. The milling and scraping tool according to claim 1, further comprising: a locking mechanism operatively connected to the plurality of selectively deployable scraping blades, the locking mechanism selectively locking the plurality of selectively deployable scraping blades in each of the retracted position and the deployed position.

3. The milling and scraping tool according to claim 2, further comprising: another locking mechanism operatively associated with the one or more selectively deployable milling blades.

4. The milling and scraping tool according to claim 1, further comprising: at least one telemetry and power module operable to communicate with a surface system.

5. The milling and scraping tool according to claim 4, wherein the at least one telemetry and power module is operable to communicate with the surface system through one of a wired connection and a wireless connection.

6. The milling and scraping tool according to claim 4, wherein the at least one telemetry and power module includes a first telemetry and power module operatively associated with the milling system and a second telemetry and power module operatively associated with the scraping system.

7. The milling and scraping tool according to claim 1, further comprising: an activation mechanism operatively associated with at least one of the milling system and the scraping system, the activation mechanism being operable to selectively shift at least one of the one or more selectively deployable milling blades and the plurality of selectively deployable scraping blades between the retracted position and the deployed position.

8. The milling and scraping tool according to claim 7, further comprising a sensor operatively associated with at least one of the activation mechanism and at least one of the plurality of selectively deployable scraping blades, the sensor being operable to determine a position of the selectively deployable plurality of scraping blades.

9. The milling and scraping tool according to claim 1, further comprising: a hydraulic pump and piston module operatively associated with the scraping system, the hydraulic pump and piston module being operable to deliver a stream of fluid from the milling and scraping tool during a scraping operation.

10. The milling and scraping tool according to claim 9, wherein the hydraulic pump and piston module is operable to selectively shift the plurality of selectively deployable scraping blades between the deployed position and retracted position.

11. The milling and scraping tool according to claim 9, further comprising: a hydraulic pump module operatively associated with the milling system, the hydraulic pump module being operable to deliver a stream of fluid from the milling and scraping tool during a milling operation.

12. A method of preparing a borehole for abandonment with a milling and scraping tool, the borehole having an inner casing and an outer casing separated by cement, the method comprising:

cutting the inner casing with a plurality of selectively deployable milling blades of a milling system portion of the milling and scraping tool; and scraping away the cement up to the outer casing with a plurality of selectively deployable scraping blades of a scraping system portion of the milling and scraping tool.

13. The method of claim 12, further comprising: circulating fluid over the plurality of selectively deployable milling blades while cutting the inner casing.

14. The method of claim 12, further comprising: circulating fluid over the plurality of selectively deployable scraping blades while scraping away the cement.

15. The method of claim 12, further comprising: signaling to the scraping system portion to shift the plurality of selectively deployable scraping blades to a deployed position.

16. The method of claim 15, further comprising: signaling to a surface system that the plurality of selectively deployable scraping blades has deployed.

17. The method of claim 15, further comprising: locking the plurality of selectively deployable scraping blades in the deployed position.

18. The method of claim 12, further comprising: signaling to the scraping system portion to shift the plurality of selectively deployable scraping blades to a retracted position.

19. The method of claim 18, further comprising: signaling to a surface system that the plurality of selectively deployable scraping blades has retracted.

20. The method of claim 18, further comprising: locking the plurality of selectively deployable scraping blades in the retracted position.

* * * * *